United States Patent [19]

Yoshida et al.

[11] 4,208,997

[45] Jun. 24, 1980

[54] CARBURETOR OUTER VENT CONTROL DEVICE

[75] Inventors: Toshiro Yoshida; Teruo Kumai, both of Toyota, Japan

[73] Assignee: Toyota Jidosha Kogyo Kabushiki Kaisha, Toyota, Japan

[21] Appl. No.: 836,393

[22] Filed: Sep. 26, 1977

[30] Foreign Application Priority Data

May 9, 1977 [JP] Japan ..... 52/53519

[51] Int. Cl.[2] ..... F02M 25/00

[52] U.S. Cl. ..... 123/136

[58] Field of Search ..... 123/136

[56] References Cited

U.S. PATENT DOCUMENTS

| | | | |
|---|---|---|---|
| 3,001,519 | 9/1961 | Dietrich et al. | 123/136 |
| 3,093,124 | 6/1963 | Wentworth | 123/136 |
| 3,191,587 | 6/1965 | Hall | 123/136 |
| 3,548,797 | 12/1970 | Hagihara et al. | 123/136 |
| 4,094,292 | 6/1978 | Takagi et al. | 123/179 G |
| 4,116,184 | 9/1978 | Tomita | 123/136 |

*Primary Examiner*—Charles J. Myhre
*Assistant Examiner*—Andrew M. Dolinar
*Attorney, Agent, or Firm*—Koda and Androlia

[57] ABSTRACT

A carburetor outer vent control device for use in a fuel system of a motor vehicle of the type including an outer vent provided in a float chamber of the carburetor, a charcoal canister and a fuel vapor line coupling the outer vent with the charcoal canister. The carburetor outer vent control device includes a valve means provided in the fuel vapor line which is only open when an excessive amount of fuel vapor is present in the float chamber and an engine of the motor vehicle is not running.

2 Claims, 4 Drawing Figures

CARBURETOR OUTER VENT CONTROL DEVICE

BACKGROUND OF THE INVENTION

1. Field of the Invention

This invention relates to carburetors and more particularly to carburetors used in emission controlled motor vehicle engines.

2. Description of the Prior Act

In conventional carburetors an outer vent is provided in the carburetor float chamber to prevent the fuel vapor generated inside the float chamber from being emitted into the atmosphere. This outer vent is connected with a charcoal canister by a fuel vapor line. The fuel vapor generated inside the carburetor float is adsorbed by the charcoal canister. The fuel adsorbed by the charcoal canister is then sent to the engine via a purge port provided in the air intake and is burned. In this case, the fuel vapor line is closed while the engine is running and is open whenever the engine is shut down.

Such conventional fuel vapor control devices suffer from a drawback in that the starting performance of the engine deteriorates after the engine has been shut down for a time longer than a given period. Specifically, the starting performance deteriorates due to the fact that the fuel vapor which aids in the starting of the engine and which is normally stored in the intake system (i.e. the intake manifold, carburetor float chamber, air cleaner, etc.,) is adsorbed by the charcoal canister when the engine is off. Furthermore, the usual type of charcoal canister also adsorbs fuel vapor from the fuel tank. The canister is connected with the fuel tank and the fuel vapor generated by the warming of the fuel tank while the vehicle is stopped is temporarily stored in the charcoal canister. However, when the fuel vapor line connecting the carburetor float chamber with the charcoal canister is open, there is a danger that a portion of the fuel vapor in the fuel tank will escape through the charcoal canister and be emitted into the atmosphere via the carburetor float chamber, air intake and air cleaner.

Accordingly it is the object of the present invention to eliminate the previously mentioned conventional drawbacks.

BRIEF SUMMARY OF THE INVENTION

Accordingly it is the general object of the present invention to provide a carburetor outer vent control device which prevents the adsorption of all the fuel vapor present in the intake system by the charcoal canister when the engine is not running.

It is another object of the present invention to provide a carburetor outer vent control device which prevents the emission of fuel vapor into the atmosphere when the engine is not running.

In keeping with the principles of the present invention, the objects are accomplished by a unique carburetor outer vent control device for use in a fuel system of a motor vehicle of the type including an outer vent provided in a float chamber of the carburetor, a charcoal canister and a fuel vapor line coupling the outer vent with the charcoal canister. The carburetor outer vent control device includes a valve means provided in the fuel vapor line which is only open when an excessive amount of fuel vapor is present in the float chamber when the engine is not running and closed when an engine of the motor vehicle is running. Such control is achieved by an electromagnetic valve which is opened for a fixed period of time after the engine is shut down or while the engine temperature is above a given level.

BRIEF SUMMARY OF THE DRAWINGS

The above-mentioned features and objects of the present invention will become more apparent by reference to the following description taken in conjunction with the accompanying drawings, wherein like reference numerals indicate like elements, and in which.

DETAILED DESCRIPTION OF THE INVENTION

Figure 1:
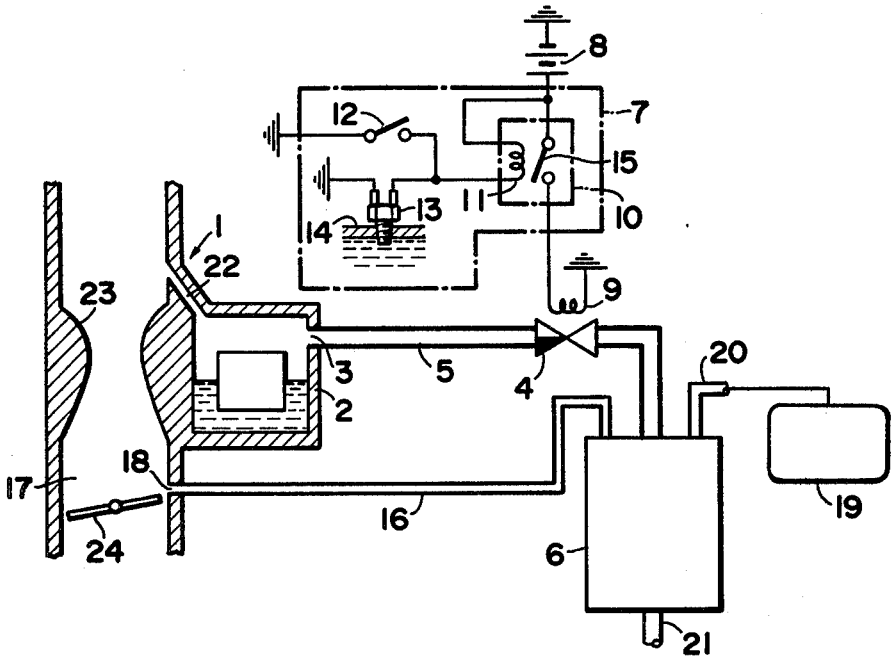
FIG. 1 is a diagram illustrating one embodiment of a carburetor outer vent control device in accordance with the teachings of the present invention.

Referring more particularly to the figures, shown in FIG. 1 is a carburetor outer vent control device in accordance with the teachings of the present invention. In FIG. 1, an outer vent 3 is formed in the outer sidewall of the float chamber 2 of the carburetor 1. The outer vent 3 is coupled to the charcoal canister 6 by a fuel vapor line 5 which has a solenoid valve 4 installed at an intermediate point of the line. The solenoid valve 4 is normally closed and opens when a control system 7 causes current to flow from the battery 8 to the solenoid 9 so that the solenoid 9 is magnetized.

Control system 7 consists of a relay 10 connected in series with the battery 8 and the solenoid 9. An ignition switch 12 is connected in series with the coil of relay 10 and a heat sensitive switch 13 is coupled in parallel with the ignition switch 12. The relay 10 is normally closed and the relay contact 15 is opened when current flows from the battery 8 through the relay coil 11 so that the later is energized. Furthermore, the heat senstive switch 13 is off whenever the temperature of the engine coolant inside the coolant jacket 14 exceeds a given value.

The charcoal canister 6 is coupled with a purge port 18 provided in the air intake 17 by a purge line 16 and is designed such that the adsorbed fuel inside the charcoal canister 6 is sucked into the air intake 17 when the engine is running. The charcoal canister 6 is further provided with an air inlet 21.

Furthermore, an inner vent tube 22 which opens into the air intake 17 is connected to the float chamber 2 so that the float chamber 2 is connected with the interior of the air intake 17. A venturi 23 and throttle valve 24 are provided in the air intake 17.

In operation, when the engine is running, the engine ignition switch 12 is on. Accordingly, current flows from the battery 8 to the relay coil 11 and the magnetization of the relay coil 11 causes the relay contact 15 to be opened. When the relay contact 15 is opened, the solenoid 9 of the solenoid valve 4 is demagnetized. This causes the solenoid valve 4 to close the fuel vapor line 5. Accordingly, the fuel vapor generated in the float chamber 2 is no longer adsorbed by the charcoal canister 6. In this case, fuel vapor is delivered to the engine via the inner vent tube 22 and the air intake 17 and is burned.

When the engine is shut off, the engine ignition switch 12 is off. If the temperature of the engine coolant exceeds a given value at this time, the heat sensitive switch 13 is also off so that the coil 11 of relay 10 is demagnetized. This causes the relay contact 15 to be closed so that current flows to the solenoid 9 of the solenoid valve 4 thereby causing the solenoid valve 4 to open the fuel vapor line 5. When the fuel vapor line 5 is opened, fuel vapor generated inside the float chamber 2 is adsorbed by the charcoal canister 6. After a certain amount of time has elapsed since the shutting off of the engine, the temperature of the engine and the engine coolant drop. When the engine coolant temperature drops below a given value, the heat sensitive switch 13 is switched on. The switching on of this heat sensitive switch 13 causes the coil 11 of the relay 10 to be magnetized so that the relay contact 15 is opened. This causes the solenoid 9 of the solenoid valve 4 to be demagnetized. When the solenoid 9 is demagnetized, the solenoid valve 4 is closed so that the adsorption of fuel vapor from the float chamber 2 into the charcoal canister 6 is interrupted. By this time, the temperature of the fuel inside the float chamber 2 has also dropped so that the fuel evaporation is greatly curtailed. Accordingly, even though the adsorption by the charcoal canister 6 is interrupted, no emission problems are created. From this point on, the fuel vapor resulting from slow evaporation remains inside the float chamber 2, the air intake 17 and the intake manifold (not shown on the figures) thereby improving the starting performance of the engine when it is started. Since the purge port 18 leading from the canister to the carburetor is provided upstream of the throttle valve, gasified fuel vapor adsorbed in the canister is not sucked into the manifold during idling, thus not affecting the air-fuel ratio during idling.

Figure 2:
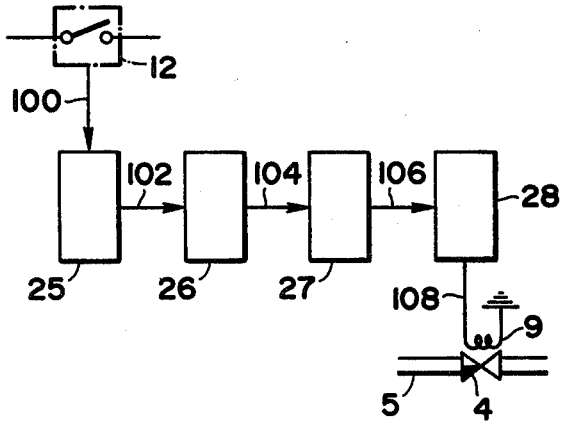
FIG. 2 is a block diagram illustrating a second embodiment in accordance with the teachings of the present invention.

Referring to FIG. 2, shown therein is a second embodiment in accordance with the teachings of the present invention. In this second embodiment, the control system 7 of the embodiment shown in FIG. 1 is modified. Since the remaining parts are identical to those in FIG. 1, their description of interconnection will be omitted and they are not shown in the FIG. 2.

The control system of FIG. 2 includes a signal inverter 25 which utilizes a metal oxide semiconductor field-effect transistor (MOSFET) to invert the on-off signal 100 of the engine ignition switch 12, a differentiating circuit 26 which differentiates the output signal 102 of the signal inverter 25 and puts out a trigger signal 104, a timer circuit 27 containing a monostable circuit or counter which puts out an on signal 106 for a fixed period of time (5 to 15 minutes) when actuated by the trigger signal 104 and a relay circuit 28 whose contact is closed by the on signal 106 from the timer circuit 27. Furthermore, in this second embodiment as well as in the first embodiment, the solenoid valve 4 is normally closed and is opened when current flows through the solenoid 9. Accordingly, it opens the fuel vapor line 5 only when current flows from the relay circuit 28 to the solenoid 9.

Figure 3:
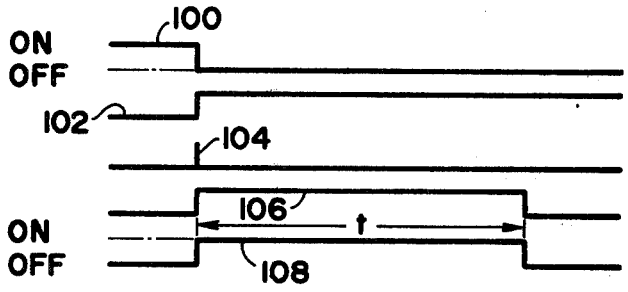
FIG. 3 is a time plot illustrating the operation of the embodiment of FIG. 2.

In operation, when a running engine is shut down, the ignition switch 12 is switched off so that the signal sent to the signal inverter 25 changes from an on to an off as indicated by the signal 100 in FIG. 3. As shown in FIG. 3, the signal inverter 25 inverts this signal 100 so that it becomes signal 102. This signal 102 is differentiated by the differentiating circuit 26 and is changed into the trigger signal 104 which is sent to the timer circuit 27. When triggered by this trigger signal 104, the timer circuit 27 sends a relay actuating signal to the relay circuit 28 for a fixed period of time t, as shown by signal 106 in FIG. 3. The relay circuit 28 is actuated by signal 106 and is switched on as indicated by signal 108 in FIG. 3 as long as signal 106 is on on and the solenoid 9 is thereby magnetized and the solenoid valve 4 is opened.

Accordingly, the fuel vapor line 5 is opened for a period of time t determined by the timer circuit 27 and the fuel vapor generated inside the float chamber 2 is adsorbed in the charcoal canister 6 via the fuel vapor line 5. A time period which corresponds to the period during which intense evaporation occurs after the shut down of the engine is desirable for the actuation time of the timer circuit 27. Since the amount of fuel vapor generated after solenoid valve 4 is closed is not very large, there is very little emission into the atmosphere via the air intake 17 and the air filter. The vapor remains inside the air intake 17 and the intake manifold (not shown) thereby improving the starting performance of the engine when it is started.

Figure 4:
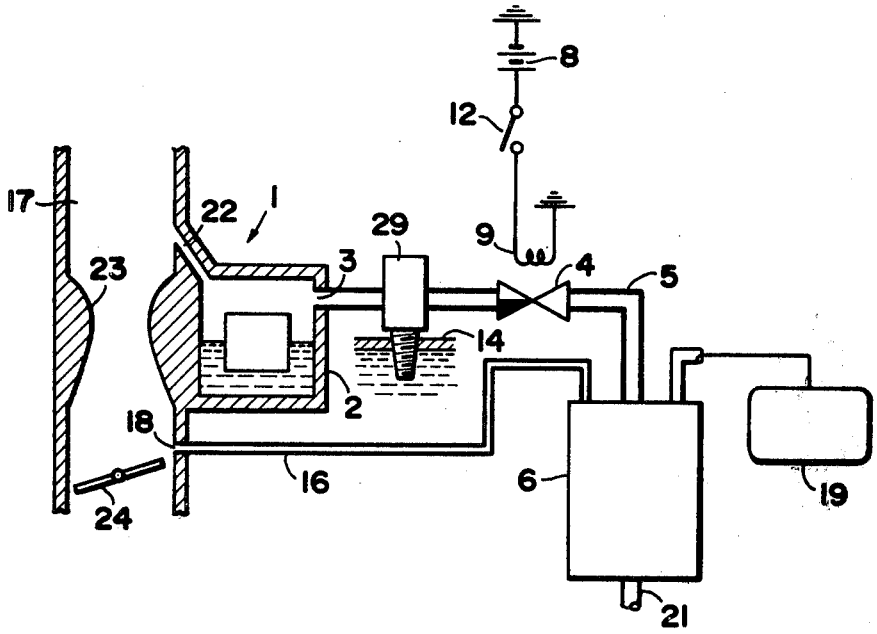
FIG. 4 is a schematic illustrating a third embodiment in accordance with the teachings of the present invention.

Referring to FIG. 4, shown therein is a third embodiment in accordance with the teachings of the present invention. In this third embodiment the fuel vapor line 5 is opened and closed by a solenoid valve 4 and a heat sensitive valve 29. The solenoid valve 4 is a normally closed valve and opens only when the ignition switch 12 is off so that no current flows to the solenoid 9 from the battery 8. Furthermore, the heat sensitive valve 28 contains thermowax, etc. which responds to the temperature of the engine coolant and the valve 29 is designed such that the vapor line 5 is opened only when the engine coolant temperature exceeds a given value.

In operation, when a running engine is shut down, the engine ignition switch 12 is switched off. This causes the solenoid valve 9 to be demagnetized so that the solenoid valve 4 is opened. Meanwhile since the heat sensitive valve 29 remains open only so long as the temperature of the engine coolant exceeds a given value the fuel vapor line 5 is connected between the float chamber 2 and the charcoal canister 6. Accordingly, the large amounts of fuel vapor generated inside the float chamber 2 while the temperature exceeds a given value after the engine is shut down are adsorbed by the charcoal canister 6 so that emission into the outside air is prevented.

When the engine is running, the ignition switch 12 is on and the solenoid 9 is magnetized. This causes the solenoid valve 4 to be closed so that the charcoal canister cannot adsorb the fuel vapor generated inside the float chamber 2 while the engine is running. Furthermore, even when the engine is shut down, the fuel vapor inside the float chamber 2 is not adsorbed by the charcoal canister 6 so long as the temperature is below a given value since the fuel vapor line 5 is closed by the heat sensitive valve 29. Since in this case the temperature is low, little fuel vapor is generated inside the float chamber 2 and adsorption by the charcoal canister is unnecessary.

Furthermore, it should be apparent that even though in the above described embodiments the temperature of the engine coolant was one of the factors which determined whether the fuel vapor line 5 was open or closed, any other means of establishing an effective relationship between the opening and closing of the fuel vapor line 5 and the amount of fuel vapor present or generated inside the float chamber 2 would also be appropriate, for example, it would also be appropriate to establish a relationship between the opening and closing of the fuel vapor line 5 in the engine temperature or the temperature of the fuel inside the float chamber 2.

In all cases it is understood that the above described embodiments are merely illustrative of but a few of the many possible specific embodiments which represent the applications of the principles of the present invention. Numerous and vary other arrangements can be readily devised by those skilled in the art without departing from the spirit and scope of the invention.

What is claimed is:

1. A carburetor outer vent control device for use in a fuel system of a motor vehicle of the type including an engine, an outer vent provided in a float chamber of a carburetor, a charcoal canister and a fuel vapor line coupling said outer vent to said charcoal canister, said carburetor outer vent control device comprising:

a source of electrical power;

a normally closed solenoid valve provided in said fuel vapor line;

a relay comprising a pair of normally closed relay contacts, one of said contacts being coupled to said source of power and the other being coupled to said solenoid valve;

a normally closed temperature switch which is responsive to a temperature of said engine; and an ignition switch coupled in parallel with said temperature switch, said parallel connection of said ignition switch and said temperature switch being coupled to and controlling said relay whereby said solenoid valve is caused to open when said engine's temperature is above a predetermined temperature and said engine is not running.

2. An outer vent control device according to claim 1 further comprising a purge port provided in said carburetor upstream of a throttle valve of said carburetor, said purge port being further coupled to said canister by a fuel line.

* * * * *